US006640352B2

(12) United States Patent
Huang

(10) Patent No.: US 6,640,352 B2
(45) Date of Patent: Nov. 4, 2003

(54) WARM/COLD DOUBLE-CIRCULATION WATER FILTER SYSTEM AND SWIMMING POOL ARRANGEMENT

(76) Inventor: Stone Huang, 7F, No. 24, Dungfeng St., Taipei (TW)

( * ) Notice: Subject to any disclaimer, the term of this patent is extended or adjusted under 35 U.S.C. 154(b) by 0 days.

(21) Appl. No.: 10/086,434

(22) Filed: Mar. 4, 2002

(65) Prior Publication Data

US 2003/0163865 A1 Sep. 4, 2003

(51) Int. Cl.[7] ..... E04H 3/16

(52) U.S. Cl. ..... 4/488; 4/489; 4/493; 4/507; 4/172; 210/169; 210/181

(58) Field of Search ..... 4/488, 489, 507, 4/493, 172, 505; 210/169, 181

(56) References Cited

U.S. PATENT DOCUMENTS 3,460,166 A * 8/1969 Weber ..... 4/493
3,623,165 A * 11/1971 Whittell, Jr. ..... 4/489
3,781,925 A * 1/1974 Curtis et al. ..... 4/493
3,837,016 A * 9/1974 Schindler et al. ..... 4/489
3,988,787 A * 11/1976 Colee ..... 4/489
4,001,899 A * 1/1977 Mathis ..... 4/489
4,240,165 A * 12/1980 Kyrias ..... 4/493
4,371,003 A * 2/1983 Goguen ..... 137/625.46
4,621,613 A * 11/1986 Krumhansl ..... 126/563
4,930,168 A * 6/1990 Ferlise ..... 4/489
5,208,923 A * 5/1993 Stiver ..... 4/493
5,422,014 A * 6/1995 Allen et al. ..... 210/743

* cited by examiner

*Primary Examiner*—Gregory L. Huson
*Assistant Examiner*—Azy Kokabi
(74) *Attorney, Agent, or Firm*—Rosenberg, Klein & Lee

(57) ABSTRACT

A warm/cold double-circulation water filter system and swimming pool arrangement comprises, a swimming pool, a double-circulation water filter system, a water pipe system, a heater. The present invention concentrated the valves in order to convenient management and control, to reduce valves amount and to offer a multiform elevated temperature manner.

2 Claims, 3 Drawing Sheets

WARM/COLD DOUBLE-CIRCULATION WATER FILTER SYSTEM AND SWIMMING POOL ARRANGEMENT

RELATED APPLICATION

This application claims priority from U.S. patent application Ser. No. 09/752,428.

FIELD OF THE INVENTION

The present invention relates to warm/cold double-circulation water filter system and swimming pool arrangement and more particularly to a pipe controlling means.

BACKGROUND OF THE INVENTION

For background, reference is made to U.S. patent application Ser. No. 09/752,428, now U.S. Pat. No. 6,425,999 which describes a double-circulation water filter system and swimming pool arrangement. The swimming pool is separated into two pools for enabling warm/cold water to be respectively circulated through the pools of the swimming pol via a divided water filter unit and enables warm/cold water to be selectively circulated through the two pools of the swimming pool. The water pipe system 4 is between a swimming pool 1 and a double-circulation water filter system 3. (refer to FIG. 4 of originally filed application). The swimming pool 1 is separated into two separated pools, a first pool 12 and a second pool 14. Each of the pools 12 and 14 has a water outlet 122 or 142, and a plurality of water inlets 124 or 144. The water pipe system 4 connects the water inlets 122 and 142 of the pools 12 and 14 to the water inlets 124 and 144 through the double-circulation water filter system 3. Electromagnetic valves A, B, C, D, E and F are installed in the water pipe system 4, and are adapted to control the direction of water flow. The inconvenient control and management of the valves that are dispersed along the water pipe system 4, raise an issue to be resolved.

SUMMARY OF THE INVENTION

It is an objective of the invention to provide a warm/cold double-circulation water filter system and swimming pool arrangement which concentrated on the valves in order to convenient management and control.

It is another objective of the invention to provide a warm/cold double-circulation water filter system and swimming pool arrangement which reduce the amount of the valves.

It is another objective of the invention to provide a warm/cold double-circulation water filter system and swimming pool arrangement which supply a multiform elevated temperature manner.

DETAILED DESCRIPTION OF THE PREFERRED EMBODIMENT

Figure 1:
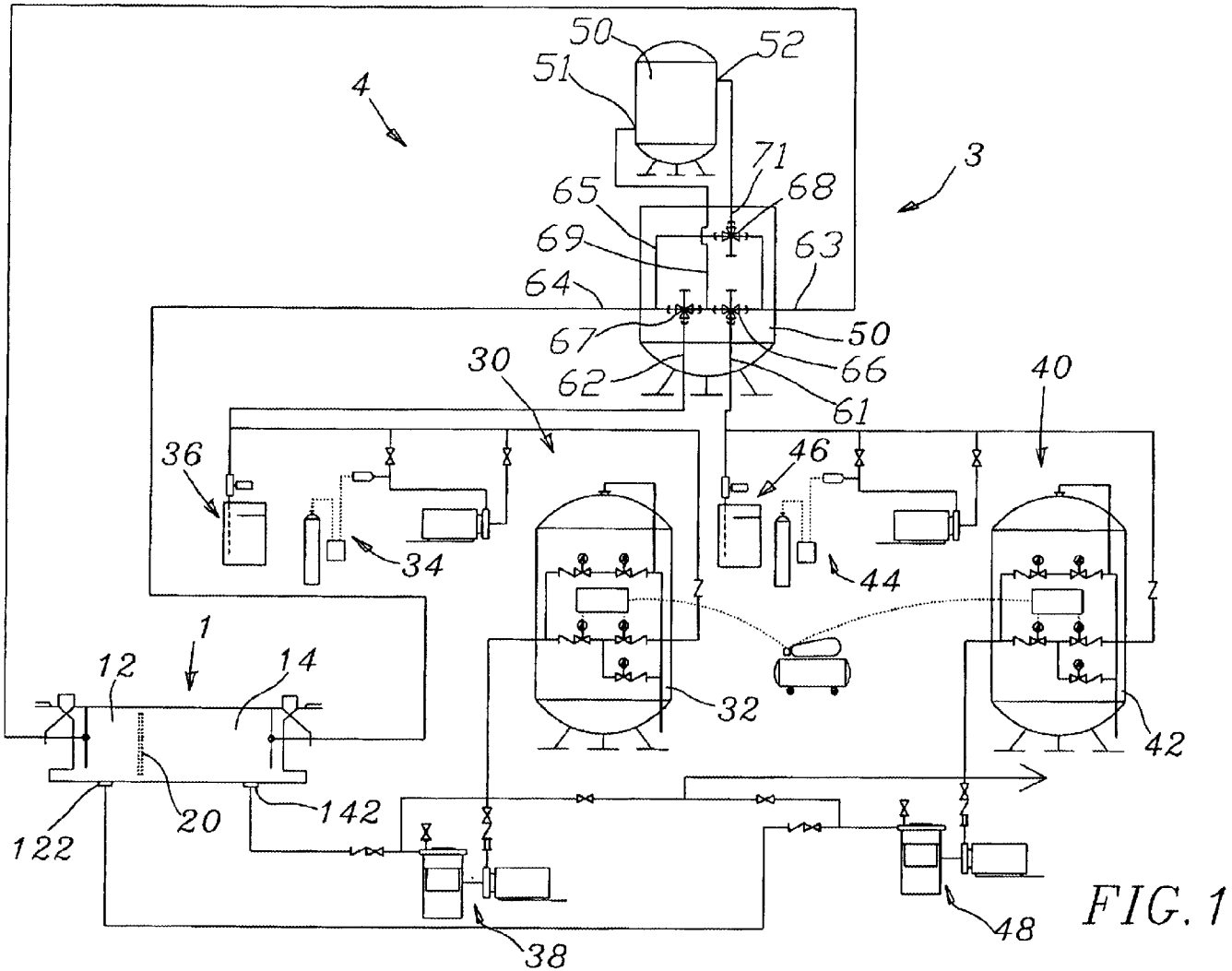
FIG. 1 illustrates the arrangement of the double-circulation water filter system and the water pipe system according to the present invention.

Referring to FIG. 1, the present invention comprises a swimming pool 1, a partition wall 20, a double-circulation water filter system 3 and a water pipe system 4. The present invention more particularly concerns the water pipe system 4 having a pipe controlling means 60 which is connected to a heater 50 by a pipe. Said pipe controlling means includes a first water inlet pipe 61, a second water inlet pipe 62, a first water outlet pipe 63 and a second water outlet pipe 64. The first water outlet pipe 61 is connected to the water outlet 122 of the pool 12 through a hair remover 48, a filter tank 42, a chlorinator 44 and a chemical dispenser 46. The first water inlet pipe 61 and the first water outlet pipe 63, connected to the water inlet 124 of said pool 12, complete the connection of the water filter system to the pool 12. The second water inlet pipe 62 is connected to the water outlet 142 of said pool 14 through a hair remover 38, a filter tank 32, a chlorinator 34 and a chemical dispenser 36. The second water inlet pipe 62 and the second water outlet pipe 64, connected to the water inlet 144 of said pool 14, complete the connection of the water filter system to the pool 14. The pipe controlling means 60 includes a connecting pipe 65, is connected to the first water inlet pipe 61, the second water inlet pipe 62, the first water outlet pipe 63 and the second water outlet pipe 64. The joint of the connecting pipe 65 and the first water inlet pipe 61 have a first control valve 66. The joint of the connecting pipe 65 and the second water inlet pipe 62 have a second control valve 67. The connecting pipe 65 has a third control valve 68 connected thereto. The first, second and third valves are each a triple valve which is used to control the direction of water flow. Furthermore, a heating pipe 69 extends between the first control valve 66 and the second control valve 67 and is connected to the hot water inlet 51 of a heater 50. The joint of the connecting pipe 65 and the third control valve 68 have a hot water outlet pipe 71, connected to the hot water outlet 52 of the heater 50.

Figure 2:
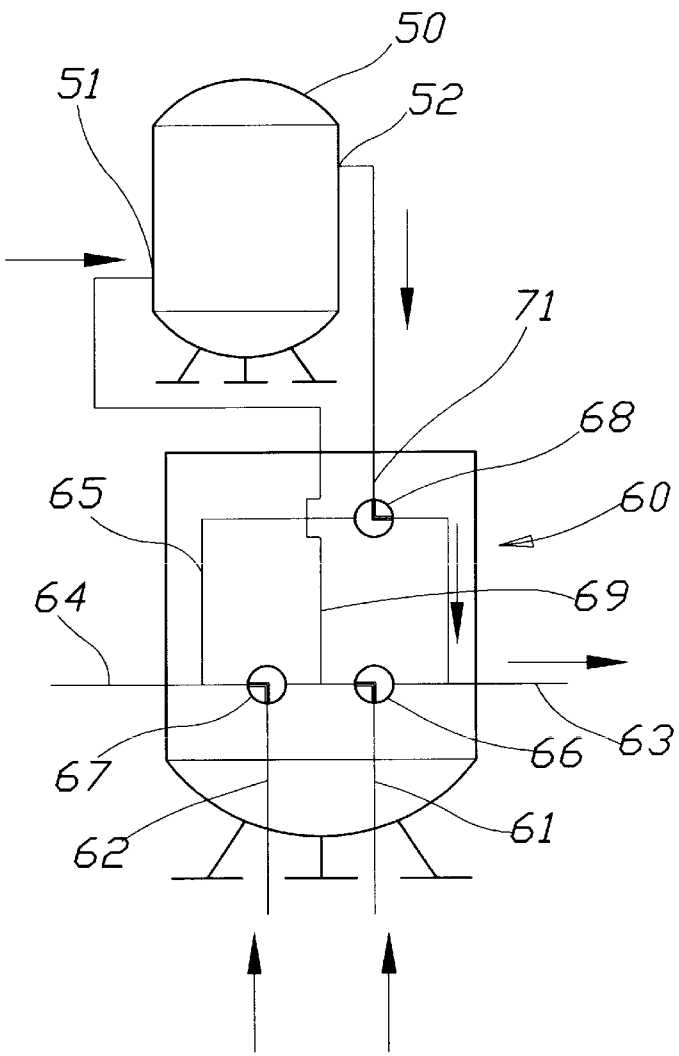
FIG. 2 illustrates the arrangement of elevated temperature device of a single swimming pool according to the present invention.

Refer to FIG. 2, the water effusion of the water outlet 122 of the pool 12 through the double-circulation water filter system 40 pass the first water inlet 61 into the pipe controlling means 60. The water of the first water inlet pipe 61 leads through the heating pipe 69 through the heater 50 by the first control valve 66. And, the water lead to the water inlet 124 of said pool 12 constructive heating circulation system by hot water outlet 52, hot water outlet pipe 71, the third control valve 68 and the first water outlet pipe 63.

Figure 3:
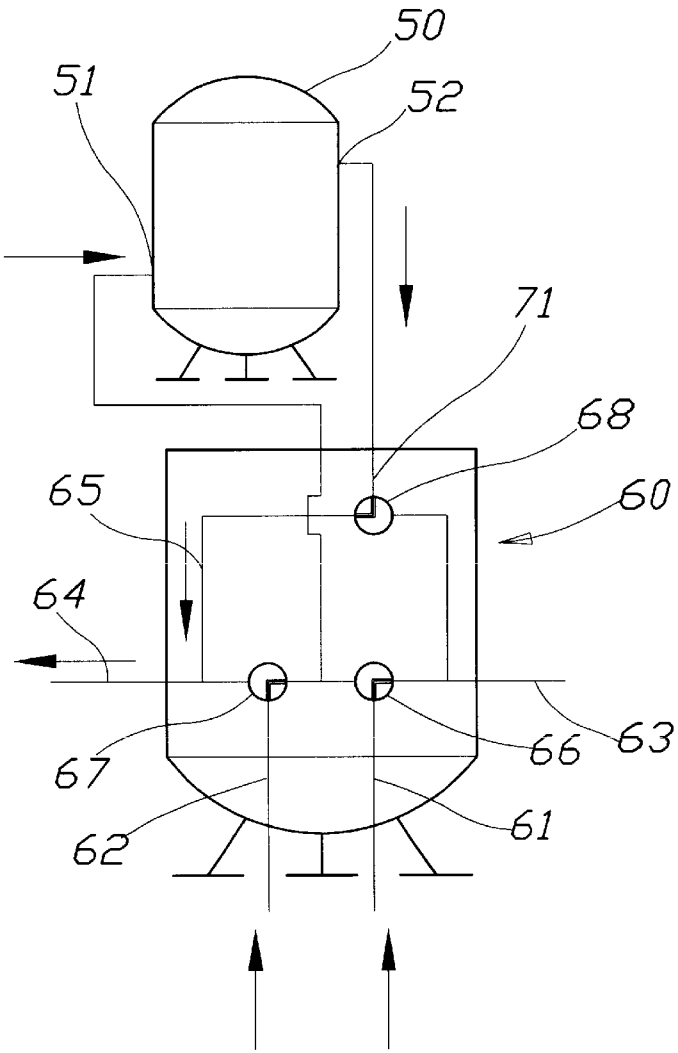
FIG. 3 illustrates the arrangement of elevated temperature device of a single swimming pool according to the present invention.

Refer to FIG. 3, the water effusion of the water outlet 142 of the pool 14 through the double-circulation water filter system 30 pass the first water inlet 62 into the pipe controlling means 60. The water of the first water inlet pipe 62 leads into the heating pipe 69 into the heater 50 by the first control valve 67. And, the water lead to the water inlet 144 of said pool 14 constructive heating circulation system by hot water outlet 52, hot water outlet pipe 71, the third control valve 68 and the first water outlet pipe 64

Figure 4:
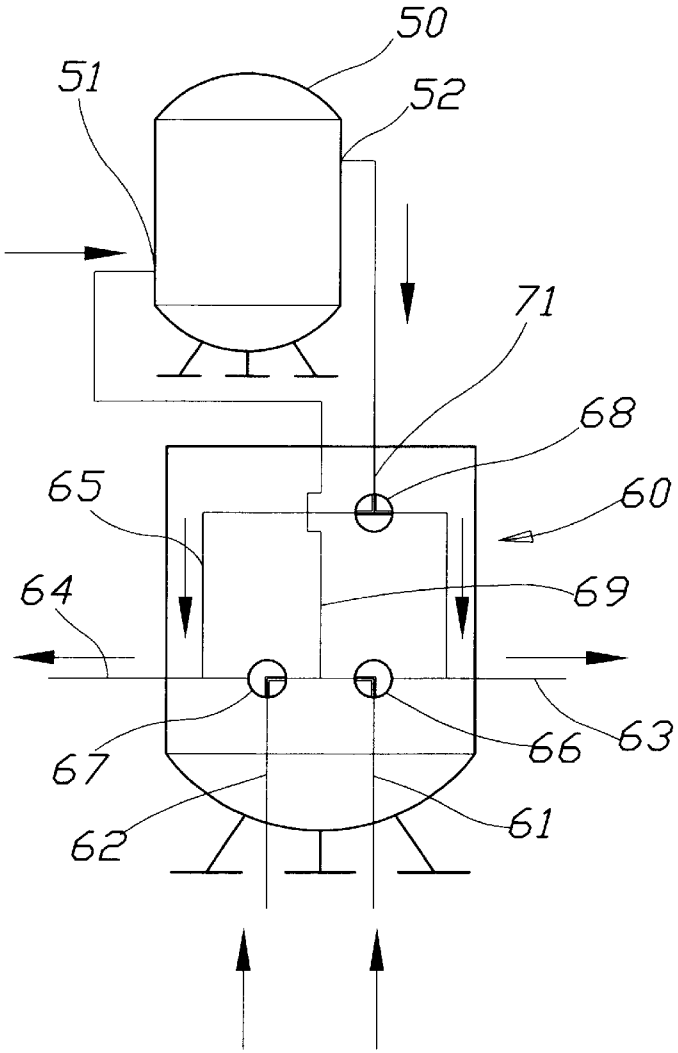
FIG. 4 illustrates the arrangement of elevated temperature device of the double swimming pool according to the present invention.

Refer to FIG. 4, the water effuse from the water outlet 122,142 of the pool 12, 14 through the double-circulation water filter system 40, 30 into pipe controlling means 60 by the first, second water inlet pipe 61,62. The water effusion of the first, second water inlet pipe 61,62 leads through the heating pipe 69 into the heater 50 by the first, second control valve 66,67. The hot water is divided effused into the water inlet 124, 144 of said pool 12,14 by the first, second water outlet pipe 63,64 and constructive heating circulation system.

Figure 5:
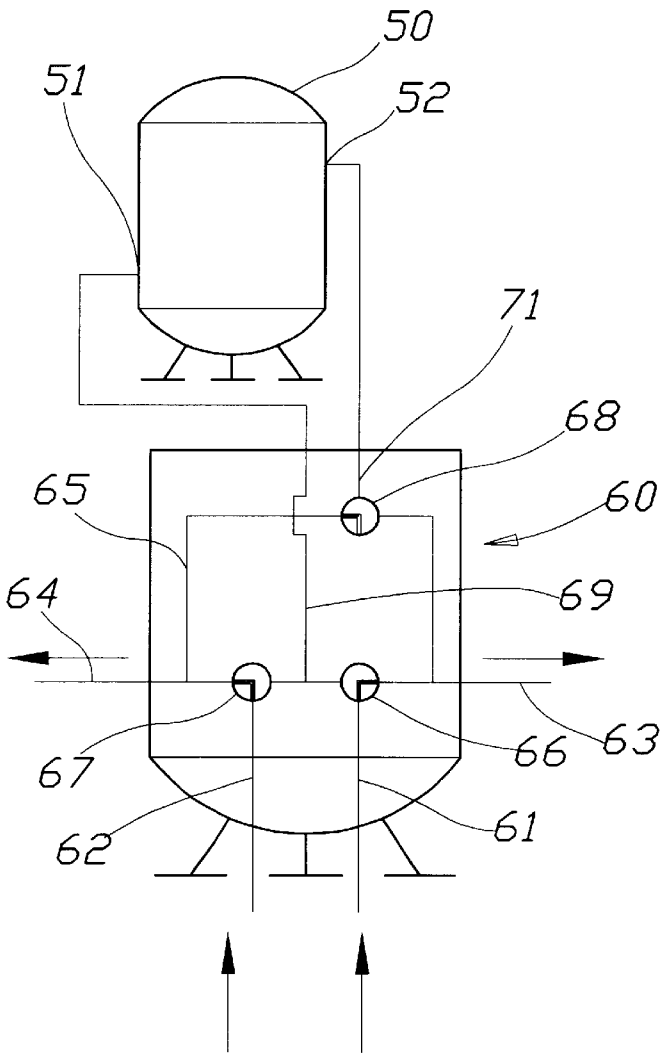
FIG. 5 illustrates the arrangement of the double cold water swimming pool according to the present invention.

Refer to FIG. 5, the water effused from outlet 122,142 of said pool 12,14 through double-circulation water filter system 40, 30 into pipe controlling means 60 by the first, second water inlet pipe 61,62. The water is divided effused into the water inlet 124, 144 of said pool 12,14 by the first, second water outlet pipe 63,64 and constructive cold water circulation filter system by the first, second control valve 66, 67.

It is to be understood that the drawings are designed for purposes of illustration only, and are not intended for use as a definition of the limits and scope of the invention disclosed.

What is claimed is:

1. A warm/cold double-circulation water filter system and swimming pool arrangement comprising:

a swimming pool, said swimming pool divided into two pools by a partition wall, each of said two pools of said swimming pool having a water outlet and a water inlet;

a double-circulation water filter system coupled in fluid communication to said swimming pool, said double-circulation water filter system including a first filter tank having an inlet coupled in fluid communication to said water outlet of a first of said two pools for filtering water circulated therefrom and a second filter tank having an inlet coupled in fluid communication to said water outlet of a second of said two pools for filtering water circulated from said second pool;

pipe controlling means for selective control of water respectively circulated to each of said first and second pools, said pipe control means including:

(a) a first control valve having a first input port and a pair of first output ports, said first control valve being operable to selectively couple said first input port in fluid communication with one of said pair of first output ports, said first input port being coupled in fluid communication to an outlet of said first filter tank, a first of said pair of first output ports being coupled in fluid communication to a first water outlet pipe and a second of said pair of first output ports being coupled in fluid communication to a heating pipe, said first water outlet pipe being coupled in fluid communication to said water inlet of said first pool;

(b) a second control valve having a second input port and a pair of second output ports, said second control valve being operable to selectively couple said second input port in fluid communication with one of said pair of second output ports, said second input port being coupled in fluid communication to an outlet of said second filter tank, a first of said pair of second output ports being coupled in fluid communication to a second water outlet pipe and a second of said pair of second output ports being coupled in fluid communication to said heating pipe, said second water outlet pipe being coupled in fluid communication to said water inlet of said second pool; and, (c) a third control valve having a third input port and a pair of third output ports, a first of said pair of third output ports being coupled in fluid communication to said first water outlet pipe and a second of said pair of third output ports being coupled in fluid communication to said second water outlet pipe; and a heater having a water inlet connected in fluid communication to said heating pipe and a water outlet connected in fluid communication to said third input port, wherein filtered heated or unheated water is selectively circulated to both of said two pools responsive to operation of said first, second and third control valves.

2. The warm/cold double-circulation water filter system and swimming pool arrangement as recited in claim 1, wherein said third control valve is operable to selectively couple said third input port in fluid communication to (a) said first of said third output ports, (b) said second of said third output ports, or (c) both said first and second of said third output ports, wherein heated filtered water or unheated filtered water is selectively circulated to both of said two pools responsive to operation of said first, second and third control valves.

* * * * *